United States Patent [19]

Bailey et al.

[11] 4,225,329

[45] Sep. 30, 1980

[54] NATURAL GAS LIQUEFACTION WITH NITROGEN REJECTION STABILIZATION

[75] Inventors: Dunn M. Bailey, Bartlesville, Okla.; Ernest A. Harper, deceased, late of Bartlesville, Okla., by Dunn M. Bailey, acting legal representative

[73] Assignee: Phillips Petroleum Company, Bartlesville, Okla.

[21] Appl. No.: 11,572

[22] Filed: Feb. 12, 1979 (Under 37 CFR 1.47)

Related U.S. Application Data

[63] Continuation-in-part of Ser. No. 802,083, May 31, 1977, abandoned.

[51] Int. Cl.[2] ..... F25J 3/02

[52] U.S. Cl. ..... 62/24; 62/26; 62/23

[58] Field of Search ..... 62/23–28

[56] References Cited

U.S. PATENT DOCUMENTS

| | | | |
|---|---|---|---|
| 2,500,129 | 3/1950 | Laverty et al. | 62/27 |
| 2,557,171 | 6/1951 | Bodle et al. | 62/23 |

*Primary Examiner*—Norman Yudkoff

[57] ABSTRACT

In a system for liquefying natural gas containing more than about 1.5 percent nitrogen in which the natural gas is cooled by refrigeration and heat exchange with initial flashing of liquid at a pressure to remove substantialy all of the container nitrogen and with additional stages of flashing of liquid with low pressure flash liquid being passed to liquid natural gas storage and flashed vapors used for heat exchange, recompressed, and combined with the incoming feed the energy requirements of the system are improved by stabilizing the amount of nitrogen recycle in the system by stripping nitrogen from the initial vapor flash with overhead from the stripping heat exchanged within the system to recover its refrigeration and then yielded from the system and with the liquid from the stripping, recycled to the liquid from the initial flashing.

4 Claims, 2 Drawing Figures

NATURAL GAS LIQUEFACTION WITH NITROGEN REJECTION STABILIZATION

Figure 1:
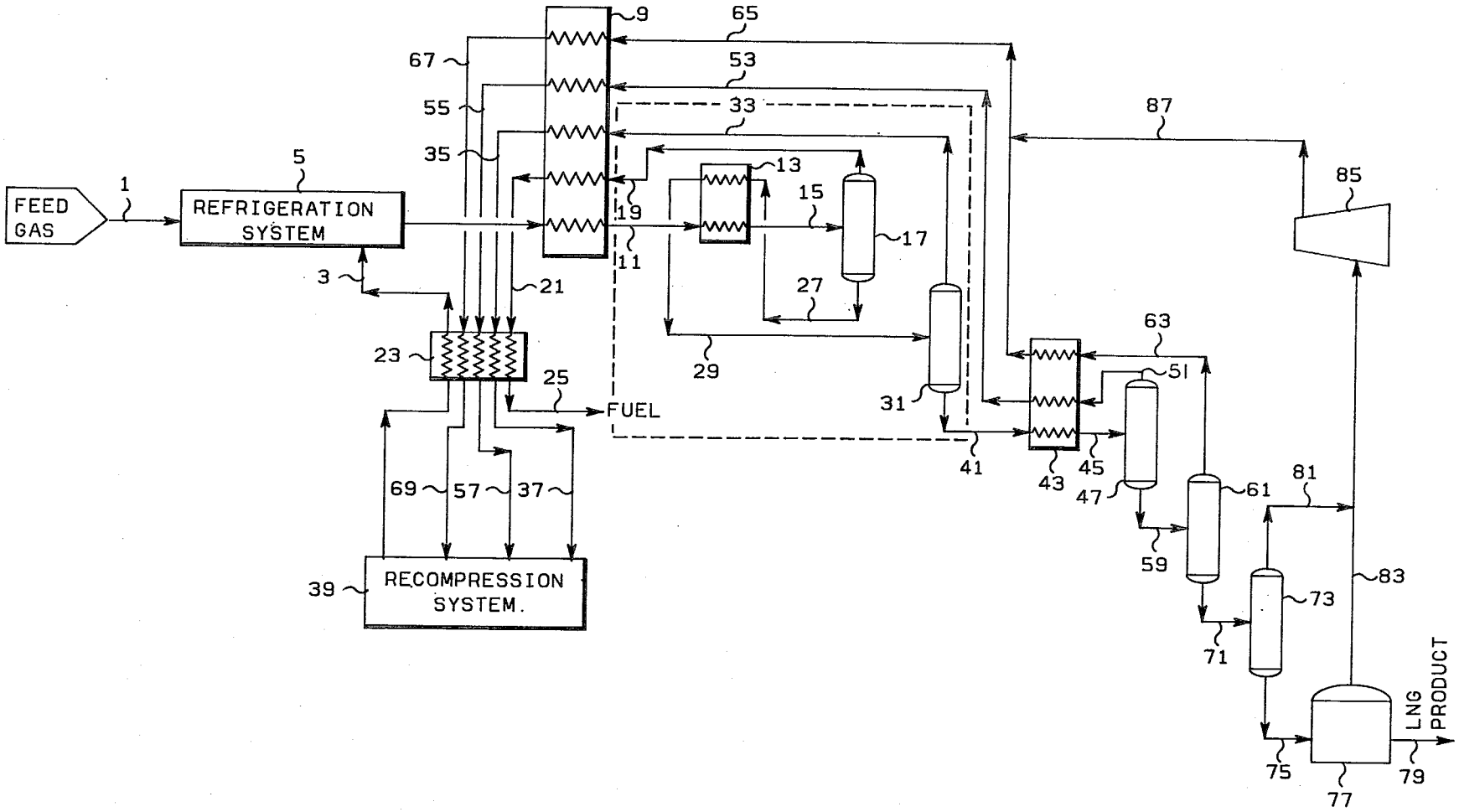

This is a continuation-in-part application of Ser. No. 802,083, filed May 31, 1977, now abandoned.

BACKGROUND OF THE INVENTION

This invention relates to the liquefying of natural gas. In one of its aspects this invention relates to the liquefying of natural gas containing at least 1.5 percent nitrogen. In another of its aspects this invention relates to improving the efficiency of a system for liquefying natural gas. In yet another of its aspects this invention relates to the removal of nitrogen from a cascade cycle in the liquefying of natural gas. In still another aspect of the invention it relates to stabilizing the nitrogen recycle in a cascade refrigeration system for liquefying natural gas containing nitrogen. The presence of nitrogen in natural gas feedstocks in quantities of about 1.5 percent or more presents problems in the liquefaction of the gas. Liquefaction systems depending on a cascade system cooling which recycle flashed vapors through a recompression system with return of the recompressed gases into the feed gas build up recycle volume of nitrogen. This problem is partially alleviated by purging some of the flash vapors from the system, generally for use as fuel, thereby removing some of the nitrogen that would otherwise be recycled. When the amount of nitrogen in the incoming gas is 1.5 percent of that gas, either the amount of vapors purged becomes excessive or the increased volume of nitrogen recycled causes the recompression system to become increasingly inefficient. The stabilization of the amount of nitrogen within the recycle system then becomes imperative.

It is therefore an object of this invention to provide a method for stabilizing the amount of nitrogen recycle is a cascade liquefaction system for natural gas. It is another object of this invention to provide apparatus and method for removing nitrogen from a cascade system for liquefying natural gas utilizing thermal capacity within the system. It is still another object of the invention to provide method and apparatus for reducing the power consumption of the recompression system within a cascade system for liquefying natural gas (LNG).

Other aspects, objects, and the various advantages of this invention will become apparent upon study of this specification, the drawings, and the appended claims.

STATEMENT OF THE INVENTION

According to the invention, in a cascade refrigeration system for liquefying natural gas containing at least 1.5 percent nitrogen in which the feed is cooled by refrigeration and heat exchange with an initial flashing of liquid at a pressure to remove substantially all, better than 90 percent, of the contained nitrogen and flashed vapor and flashed liquid streams and with additional flashing of liquid with low-pressure flashed liquid passing to LNG storage and with all flashed vapors used for heat exchange, recompressed, and combined with the incoming feed, the nitrogen content of the recycled vapors is stabilized by stripping the partially condensed flashed vapors from the initial flashing of liquid of part of the nitrogen content with recovery of refrigeration from the stripped vapors by heat exchange within the system and yielding the stripped vapors from the system and with return of liquid from which nitrogen has been stripped to the liquid stream from the initial flashing.

In one embodiment of the invention flashed liquid from the flashing of natural gas cooled to a range of about −180° F. to about −150° F., preferably about −160° F. (−107° C.) by flashing to a pressure in the range of about 200–350 psia (1.38–2.42 MPa), preferably about 325 psia (2.24 MPa), is further flashed to about 160–200 psia (1.10–1.38 MPa) with flashed liquid at about 180 psia (1.24 MPa) used as cooling liquid for indirect heat exchange with the vapors flashed at about 325 psia (2.24 MPa), used in cooling the inlet stream, and used in part with further cooling and flashing to produce the liquid natural gas.

In a further embodiment of the invention vapor initially flashed to a temperature of about −180° F. to about −150° F., preferably about −160° F. (−107° C.), by flashing to a pressure in the range of about 200–350 psia (1.38–2.42 MPa), preferably about 325 psia (2.24 MPa) is indirectly heat exchanged with liquid flashed at about 160–200 psia (1.10–1.38 MPa) and fed into the upper portion of a nitrogen stripping column maintained at about 325 psia (2.24 MPa) and reboiled by indirect heat exchange with liquid at about −137° F. (−93.9° C.) effectively to remove nitrogen overhead.

The invention is best pointed out in connection with the drawings in which

Figure 2:
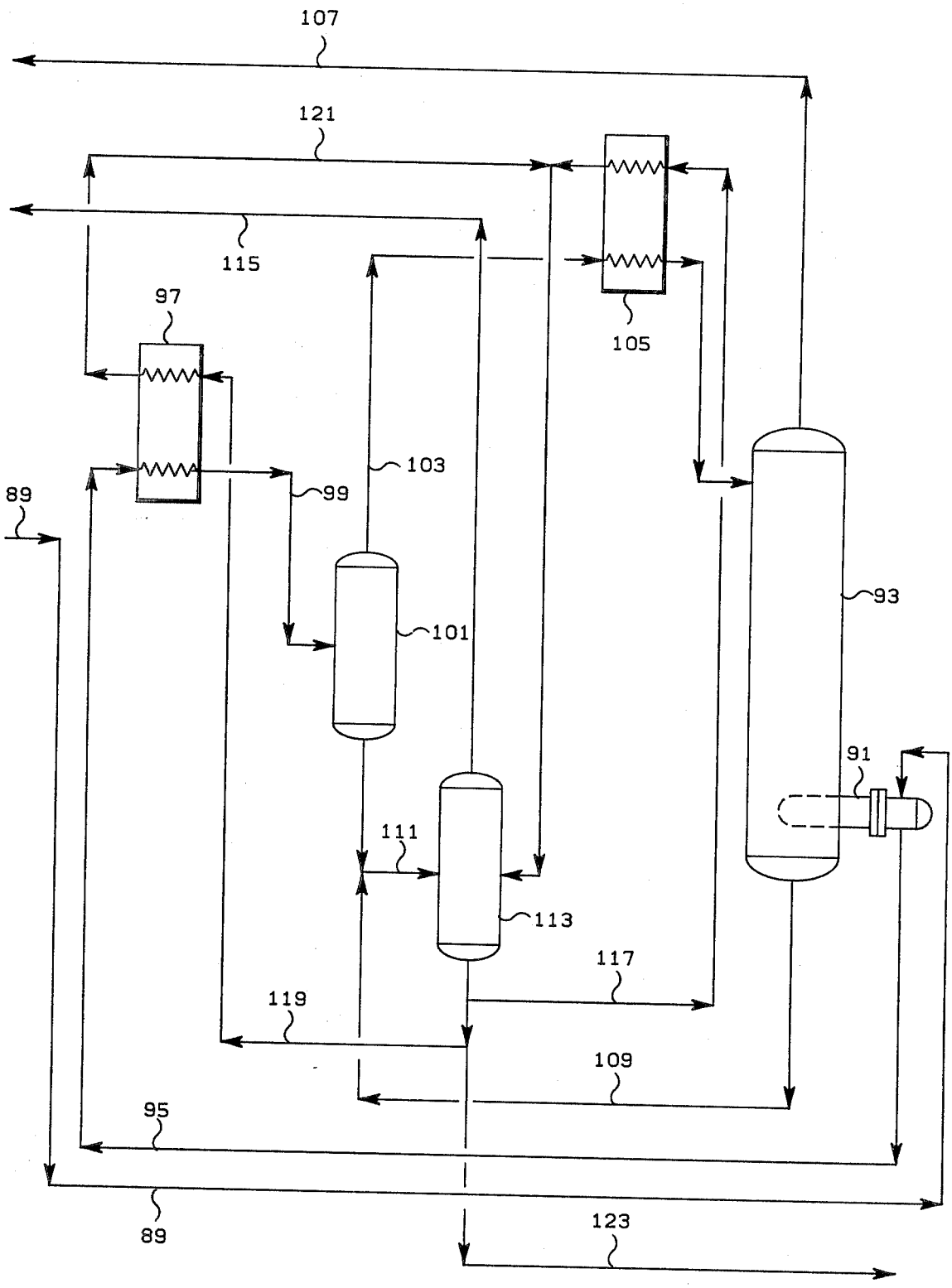

FIG. 1, with its inset nitrogen removal portion, is a schematic of the type of cascade refrigeration system for liquefying natural gas that is well known to the art and FIG. 2 is a schematic of a nitrogen removal system which, according to this invention, stabilizes the nitrogen recycle in the same cascade refrigeration system for liquefying natural gas.

Referring now to FIG. 1 of the drawing, in a typical system 420 MMSCFD (138 $m^3/s$) of dehydrated natural gas with the following composition in mol percent: nitrogen 1.71, methane 94.87, ethane 2.46, propane 0.55, i-butane 0.12, n-butane 1.15, i-pentane 0.06, n-pentane 0.04, and hexanes 0.04, enters the system as feed gas through line 1. This stream is joined by a recycle stream 3 of about 375 MMSCFD (123 $m^3/s$) methane-nitrogen and passes through an ethane refrigeration system 5 of a type well known in the art and thence through line 7 and heat exchanger 9 in which there is indirect heat exchange with flash vapors from all the flash tanks in the cascade system. The feed gas and recycle stream now cooled to −141° F. (−96° C.) and 616 psia (4.25 MPa) pass through line 11 and heat exchanger 13 in which there is indirect heat exchange with flashed liquid from a first flash tank 17 so that upon exiting heat exchanger 13, condensed liquid in line 15 is at a temperature of −159° F. (−106° C.) and a pressure of 612 psia (4.22 MPa). This liquid is expanded in first flash tank 17 to a temperature of −164° F. (−109° C.) and a pressure of 325 psia (2.24 MPa). Flashed vapors containing about 17.6 mol percent nitrogen are passed through line 19 and heat exchanger 9 countercurrent to the inlet stream through line 21 and heat exchanger 23, in which it is used to refrigerate recompressed flash vapors from the cascade system, and thence through line 25 to be yielded from the system. The flashed liquid is passed through line 27, countercurrently in indirect heat exchange with the inlet stream through heat exchanger 13 and through line 29 to a second flash tank 31. The flash liquid from the first flash tank is expanded in second flash tank 31 to a pressure of about 179 psia (1.23 MPa) and a temperature of −188° F. (−122° C.). Flashed vapors from the second flash tank are taken through line 33 in countercurrent heat exchange with the incoming feed in heat exchanger 9 through line 35 in countercurrent heat exchange with recompressed flashed vapor in heat exchanger 23 through line 37 into recompression system 39. Recompression system is a typical multistage compression system. The flashed liquid from the second flash tank passes through line 41, heat exchanger 43, and line 45 to a third flash tank 47. In the third flash tank 47 the liquid is expanded to a pressure of 59 psia (0.86 MPa) and a temperature of −225° F. (−143° C.). Vapors from the flashing pass through line 51 countercurrent to the feed, going into the third flash tank through heat exchanger 43 and through line 53, heat exchanger 9, line 55, heat exchanger 23, and line 57 to the recompression system. The flashed liquid from the third flash tank passes through line 59 and is expanded in fourth flash tank 61 to a pressure of 25 psia (0.17 MPa) and a temperature of −246° F. (−154° C.). Flashed vapor from the fourth flash tank passes through line 63, heat exchanger 43, line 65, heat exchanger 9, line 67, heat exchanger 23, and line 69 into the recompression system. The flashed liquid from the fourth flash tank passes through line 71 to a fifth flash tank 73 in which it is expanded to a pressure of 15 psia (0.10 MPa) and a temperature of −259° F. (−161° C.) with the liquefied natural gas passing as flashed liquid from this flash tank to line 75 into storage 77 from which it can be withdrawn as liquid natural gas product through line 79. Flashed vapor from the fifth flash tank passes through line 81 as does vent from the storage tank through line 83 to become compressed by a recompression unit 85 and passed through line 87 back into line 65.

To the above-described process which is well known in the art, the present invention introduces a nitrogen stripping system which stabilizes the nitrogen recycle passing through the recompression system and thence recycling to the feed gas. Referring now to FIG. 2, which describes a nitrogen stripping system, which according to the present invention replaces the heat exchange and flash system which are described according to the processes of the prior art as heat exchanger 13, first flash tank 17, and second flash tank 31 and the attendant piping with the remainder of the system the same as before-described.

According to the present invention, 420 MMSCFD (138 $m^3/s$) of dehydrated natural gas and 375 MMSCFD of methane-nitrogen recycle having passed through refrigeration system 5 and heat exchanger 9 are cooled to a temperature of −137° F. (−94° C.) at a pressure of 616 psia (4.25 MPa). This stream is passed through line 89 in indirect heat exchange through the means of reboiler 91 with the liquid in nitrogen stripper 93. The stream passes by line 95 through heat exchanger 97 and line 99 into a first flash tank 101. Here, the liquid that has been cooled by heat exchange to a temperature of −143° F. (−97° C.) is expanded to −159° F. (−106° C.) at 325 psia (2.24 MPa). Flashed vapor from this first flash tank passes through line 103 and heat exchanger 105 to the top of the nitrogen stripper 93. Passing through heat exchanger 105 the nitrogen-rich flash vapor is further cooled and partially condensed at −166° F. (−110° C.). The nitrogen stripper 93 operates at a pressure of about 325 psia (2.24 MPa). Overhead gas, which is about 18.7 mol percent nitrogen passes from the nitrogen stripper and line 107, through heat exchanger 9 where it is heat exchanged with the incoming feed and recycled methane streams and thence through line 21 and heat exchanger 23 and passed from the system through line 25. Bottoms liquid from nitrogen stripper 93 passes through line 109 to be joined with the flash liquid from the first flash tank 101 in line 111 from which it passes into the second flash tank 113 where it is expanded to about 180 psia (1.24 MPa). Flashed vapors from the second flash tank pass through line 115, through heat exchanger 9, and thence through line 35 to the recompression system. The liquid from the second flash tank 113 is divided into streams that pass through line 117 and heat exchanger 105 where it is used to cool and condense vapors from the first flash tank 101 before they pass into nitrogen stripper 93. Another portion of the flashed liquid from the second flash tank 113 passes through line 119 in counter-current flow through heat exchanger 97 where it cools the inlet stream for the first flash tank 101 and then passes through line 121 where it is joined by the heat exchanged flashed liquid that has passed through heat exchanger 105 and returned to the second flash tank 113. The remainder of the liquid from flash tank 113 passes through line 123, heat exchanger 43 and line 45 into the third flash tank 47.

As will be seen in the table below, stabilizing the nitrogen recycle by the use of a nitrogen stripper in the process described above as compared to the well-known process also described above minimizes the power requirements in the recompression system. This produces a more economical system.

Table I

| | Power Requirements | | | |
|---|---|---|---|---|
| | With Stripper | | With Flash | |
| Nitrogen in Feed, % | BHP/ MMSCFD | $KW/m^3/s$ | BHP/ MMSCFD | $KW/m^3/s$ |
| 1.71 | 436.2 | 994 | 448.7 | 1022 |
| 3.91 | 442.8 | 1009 | — | |
| 6.00 | 455.5 | 1038 | — | |

The table above sets out power requirements when the nitrogen in the feed is varied upward. The first case compares a nitrogen content of 1.71 mol percent for a system using the stripper (the present invention) and a system with flash (the prior art). For the case using a nitrogen content of 1.71 mol percent the power requirements are obviously superior using the nitrogen stripper for stabilizng nitrogen recycle in the system. The conditions of operation and resulting power requirements were worked out by computer. Unfortunately, the computer program would not converge on cases with higher nitrogen feed contents than 1.71 mol percent when a stripper was not used, but it was apparent that the gas recycle volumes were sufficiently large as compared to the system using the nitrogen stripper that the economies dictate the use of the nitrogen stripper.

We claim:

1. In a cascade refrigeration system for liquid natural gas containing at least 1.5 percent nitrogen in which the feed is cooled by refrigeration and heat exchange with intial flashing of liquid to a pressure sufficient to produce a flashed vapor stream containing substantially all of the contained nitrogen and a flashed liquid stream and with recycled vapors used for heat exchange, recompressed, and combined with the incoming feed, a method for stabilizing the nitrogen content of the recycled vapors comprising:

(a) passing the natural gas containing at least 1.5 percent nitrogen through an indirect heat exchanger for reboiling the kettle of a nitrogen stripping column;

(b) initially flashing the effluent natural gas from (a) to a pressure sufficient to produce a flashed vapor stream containing substantially all of the contained nitrogen and a flashed liquid stream;

(c) subjecting the flashed vapors from the initial flashing of liquid to a stripping operation in a nitrogen stripping column to remove at least part of the nitrogen content;

(d) recovering refrigeration from the vapor stripped from said flashed vapors by heat exchange within the system;

(e) yielding the stripped vapors from the system;

(f) returning as a liquid the stream from which nitrogen has been stripped to the liquid stream produced from the initial flashing of liquid; and (g) further flashing flashed liquid from the initial flashing of natural gas with liquid produced from this flashing operation used in part as cooling liquid for indirect heat exchange with the vapors from the initial flashing and in part for further cooling and flashing to produce a liquified natural gas.

2. A method of claim 1 wherein said further flashing of step (g) produces a liquid at about 160–200 psia (1.10–1.38 MPa).

3. A method of claim 2 wherein vapor from the initial flashing is indirectly heat exchanged with liquid at about 160–200 psia (1.10–1.38 MPa) and then is fed into the upper portion of the nitrogen stripping column.

4. A method of claim 3 wherein said nitrogen stripping column is operated at a pressure within the range of about 200 to about 350 psia (1.38–2.42 MPa).

* * * * *